US009033146B2

(12) United States Patent
Higdon et al.

(10) Patent No.: US 9,033,146 B2
(45) Date of Patent: May 19, 2015

(54) LOOP CLIPS FOR GOLF BAGS AND METHODS TO MANUFACTURE GOLF BAGS

(71) Applicant: Karsten Manufacturing Corporation, Phoenix, AZ (US)

(72) Inventors: David A. Higdon, Phoenix, AZ (US); James D. Martell, Phoenix, AZ (US)

(73) Assignee: Karston Manufacturing Corporation, Phoenix, AZ (US)

( * ) Notice: Subject to any disclaimer, the term of this patent is extended or adjusted under 35 U.S.C. 154(b) by 82 days.

(21) Appl. No.: 13/759,176

(22) Filed: Feb. 5, 2013

(65) Prior Publication Data

US 2014/0216962 A1 Aug. 7, 2014

(51) Int. Cl.
*A63B 55/08* (2006.01)
*A63B 55/00* (2006.01)

(52) U.S. Cl.
CPC ..... *A63B 55/008* (2013.01)

(58) Field of Classification Search
CPC ..... A63B 55/08; A63B 55/00; A63B 55/008
USPC ..... 206/315.3, 527; 383/13, 20; 224/257, 224/605, 617, 618, 258, 259; 150/107; 24/136 R, 67.9, 30.5, 30.5 T, 563, 30.5 P
See application file for complete search history.

(56) References Cited

U.S. PATENT DOCUMENTS 143,668 A * 10/1873 Clark ..... 54/74
656,805 A * 8/1900 Bowman ..... 24/562
1,865,509 A * 7/1932 Domkee ..... 24/200
2,212,862 A * 8/1940 Hirsh ..... 24/198
2,233,397 A * 3/1941 Bloom ..... 119/857
2,293,562 A * 8/1942 Rosenthal ..... 24/200
2,337,786 A * 12/1943 Wasserman ..... 132/281
2,849,773 A * 9/1958 Kaselow ..... 24/200
3,242,542 A * 3/1966 Tako ..... 24/68 F
3,796,357 A 3/1974 Johnson
4,414,716 A * 11/1983 Stastney ..... 24/3.12
4,541,540 A 9/1985 Gretz et al.
5,068,945 A 12/1991 Hart et al.
5,165,583 A 11/1992 Kouwenberg
5,573,211 A * 11/1996 Wu ..... 248/96
5,608,918 A * 3/1997 Salvaggio ..... 2/421
5,954,255 A * 9/1999 Beebe et al. ..... 224/645
6,152,338 A * 11/2000 Smith ..... 224/149
6,328,192 B1 12/2001 Sundara et al.
6,389,652 B1 * 5/2002 Williams ..... 24/30.5 R
6,530,129 B1 * 3/2003 Cheng ..... 24/200
6,599,015 B1 * 7/2003 Bogatez ..... 383/6
6,684,466 B2 * 2/2004 Nishida et al. ..... 24/615
D505,616 S * 5/2005 Wingerter et al. ..... D8/383
7,140,080 B2 * 11/2006 Fildan et al. ..... 24/302
7,681,288 B1 * 3/2010 Giampavolo ..... 24/615
7,770,264 B2 * 8/2010 Dreyer ..... 24/67.9
7,942,889 B2 * 5/2011 Assia ..... 606/151
8,220,112 B2 7/2012 Hofmann et al.
8,256,063 B2 9/2012 Bowman
2004/0026901 A1 2/2004 Yann et al.
2005/0121484 A1 * 6/2005 Meyer ..... 224/629
2009/0184144 A1 * 7/2009 Kim ..... 224/258
2014/0076752 A1 * 3/2014 Hicks et al. ..... 206/315.6

* cited by examiner

*Primary Examiner* — Sue A Weaver

(57) ABSTRACT

Embodiments of a loop clip used with a golf bag and methods to manufacture a golf bag are generally described herein. Other embodiments of the loop clip may be described and claimed.

14 Claims, 6 Drawing Sheets

LOOP CLIPS FOR GOLF BAGS AND METHODS TO MANUFACTURE GOLF BAGS

FIELD

The present document relates to golf bags, and in particular to loop clips for engaging one or more straps to a golf bag during assembly.

BACKGROUND

During the manufacturing of a golf bag, straps may be sewn in place to engage the straps to the golf bag to make the straps a permanent addition to the golf bag. However, this fastening step requires that the straps be sewn or otherwise fastened to the golf bag at a very specific time during the manufacturing process. Once the golf bag is manufactured in such a manner, it is usually shipped for final assembly in which the assembly worker is required to thread the webbing of the golf bag through the double carrying straps one at a time, which can be time consuming and difficult to accomplish. As such, a bottleneck may be created in the assembly line process, which can frustrate workers and increase the cost of manufacture.

BRIEF DESCRIPTION OF THE DRAWINGS

Corresponding reference characters indicate corresponding elements among the view of the drawings. The headings used in the figures do not limit the scope of the claims.

DESCRIPTION

Figure 1:
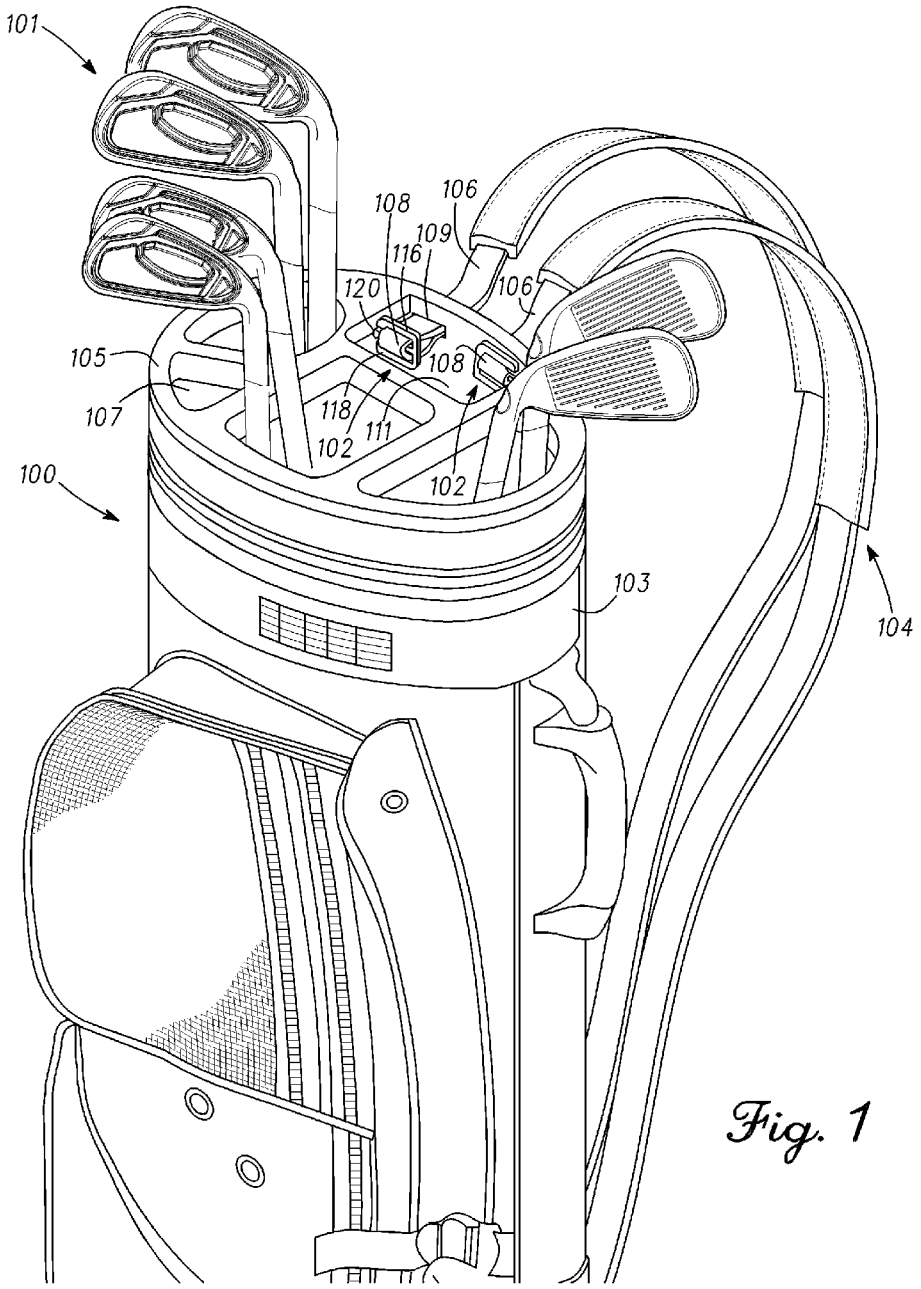
FIG. 1 is a perspective view of a golf bag with first and second straps of a carrying strap assembly engaged to respective loop clips during assembly of the golf bag.

A golf bag and method of manufacturing a golf bag using a loop clip that makes the assembly of the golf bag quick, efficient, and easier is described herein. Referring to the drawings, an embodiment of a golf bag is illustrated and generally indicated as 100 in FIGS. 1-13. In one embodiment shown in FIG. 1, the golf bag 100 may include a pair of loop clips 102 configured to engage a respective strap 106 that forms a part of a carrying strap assembly 104 to secure the carrying strap arrangement 104 through engagement of each strap 106 to the golf bag 100. As shown, the golf bag 100 includes a golf bag body 103 having an open top end portion 105 in communication with an interior area 107 configured to receive a plurality of golf clubs 101. As further shown, the interior area 107 of the golf bag 100 is defined by an inner surface 111. In some embodiments, the inner surface 111 of the golf bag body 103 communicates with first and second slot openings 109 formed through the golf bag body 103 with each respective slot opening 109 being configured to receive a respective strap 106 therethrough such that the closed loop end 108 formed at the free end of each strap 106 extends into the interior area 107 of the golf bag 100. In some embodiments, the closed loop end 108 of each strap 106 may be engaged to a respective loop clip 102 to secure and retain the closed loop end 108 of each strap 106 within the interior area 107, and against the inner surface 111 of the golf bag 100 adjacent respective first and second slot openings 109.

Figure 4:
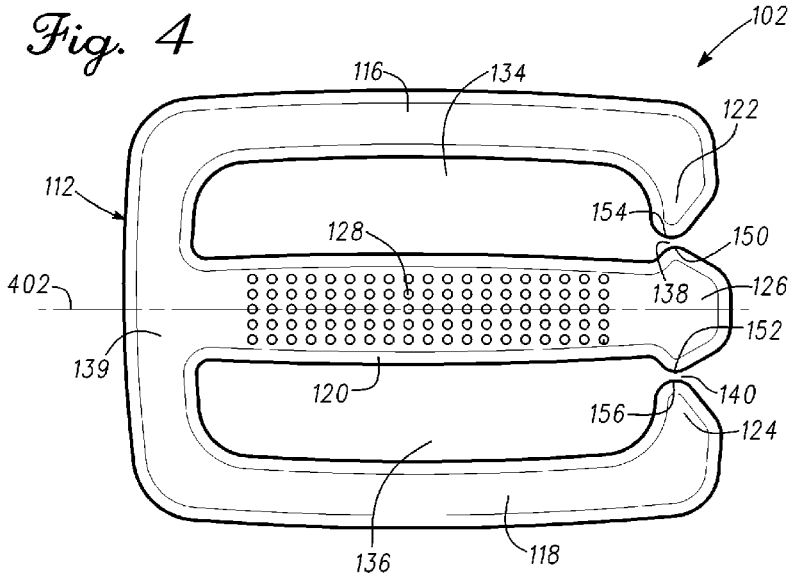
FIG. 4 is a top plan view of the loop clip.
Figure 5:
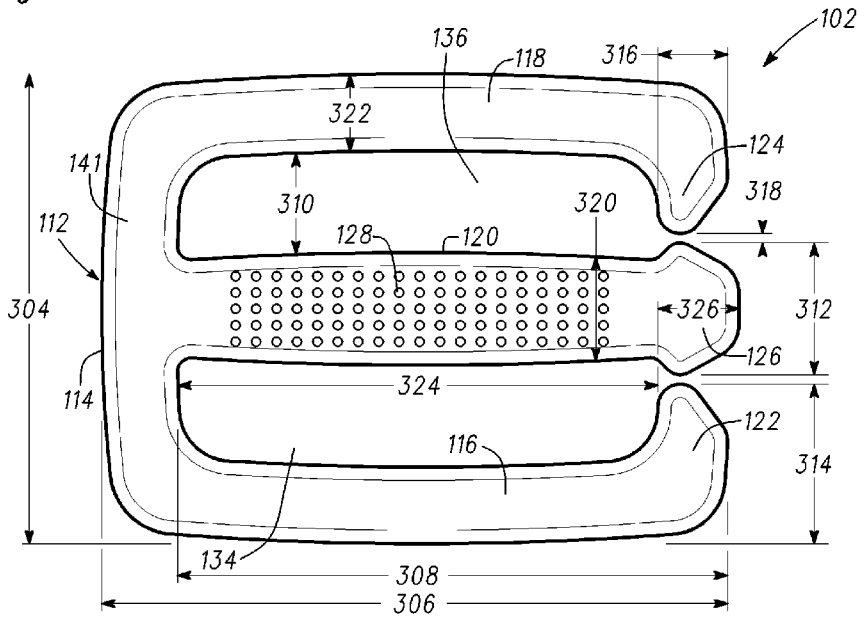
FIG. 5 is a bottom plan view of the loop clip.
Figure 12:
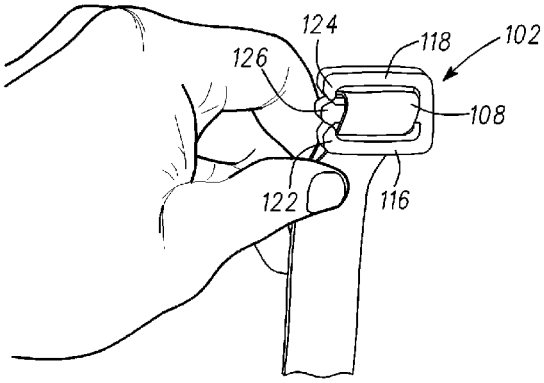

Referring to FIGS. 1-9, in one embodiment each loop clip 102 includes a clip body 112 defining a front surface 139 (FIG. 4) and a rear surface 141 (FIG. 5). In addition, the clip body 112 defines a rear portion 114 with a first side portion 116, a second side portion 118, and a middle portion 120 which collectively extend outwardly in substantially perpendicular fashion from the rear portion 114 and in a substantially parallel orientation relative to each other along a longitudinal axis 402 (FIG. 4). As shown in FIG. 4, the middle portion 120 is interposed between the first side portion 116 and the second side portion 118 such that a first slot 134 is defined between the middle portion 120 and the first side portion 116, while a second slot 136 is defined between the middle portion 120 and the second side portion 118. As shown, the first slot 134 is in communication with a first opening 138 and a second slot 136 is in communication with a second opening 140. This arrangement allows the closed loop end 108 of the strap 106 to pass through the first and second openings 138 and 140 as the middle portion 120 of the loop clip 102 is inserted through the channel 110 such that the closed loop end 108 resides within the first and second slots 134 and 136 and substantially surrounds the middle portion 120 when the loop clip 102 is fully engaged to the closed loop end 108 of the strap 106 as shown in FIG. 12.

Figure 6:
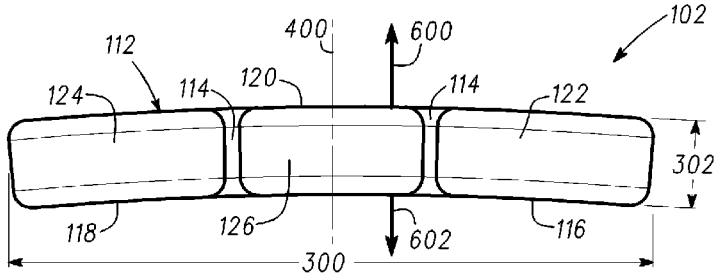
FIG. 6 is an front end view of the loop clip.
Figure 7:
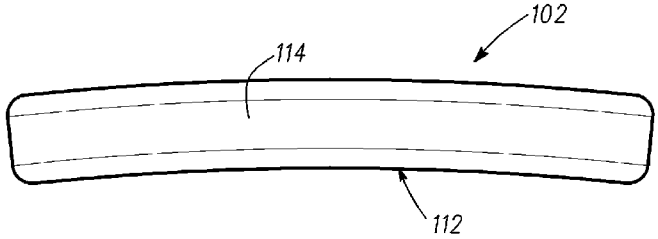
FIG. 7 is a rear end view of the loop clip.
Figure 8:
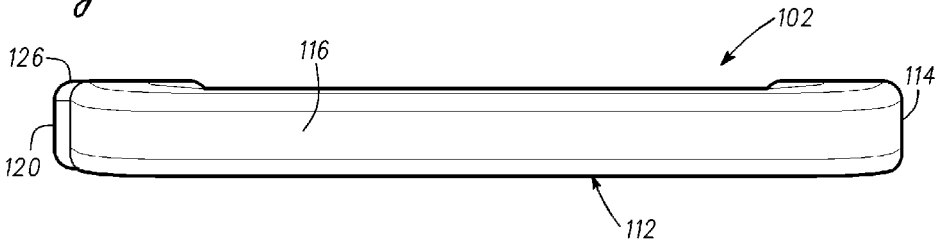
FIG. 8 is a side view of the loop clip.
Figure 9:
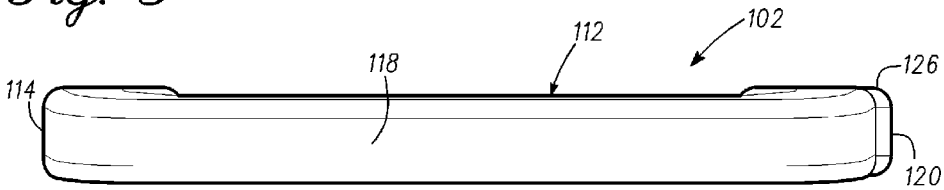
FIG. 9 is an opposing side view of the loop clip.

As shown in FIGS. 6 and 7, in one embodiment the rear portion 114 may define a generally concave configuration, wherein the first side portion 116 and the second side portion 118 may be slightly lower relative to the middle portion 120. In general, the first side portion 116 and the second side portion 118 may extend outwardly in a substantially perpendicular fashion from the rear portion 114 and oriented in a substantially parallel fashion relative to the middle portion 120. As shown in FIG. 6, the first side portion 116 defines a first inward arm 122 forming an outward protrusion 154 (FIG. 4) at the free end thereof, while the second side portion 118 defines a second inward arm 124 forming an outward protrusion 156 (FIG. 4) at the free end thereof.

Figure 2:
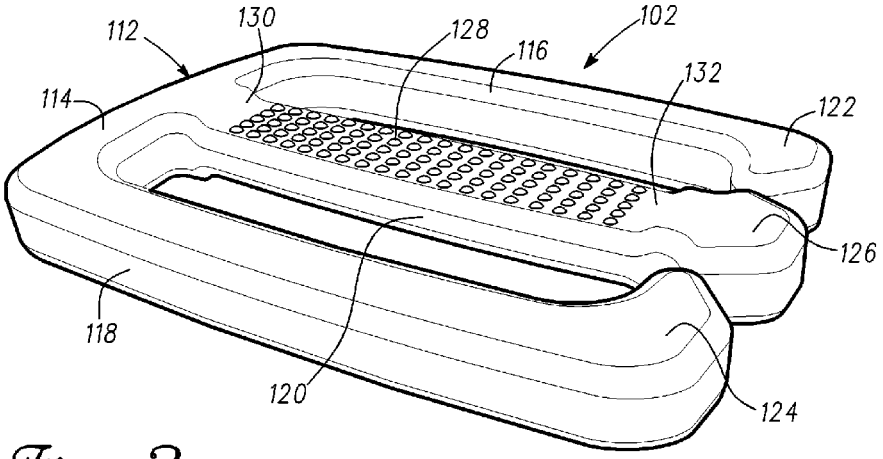
FIG. 2 is an elevated perspective view of the loop clip.
Figure 3:
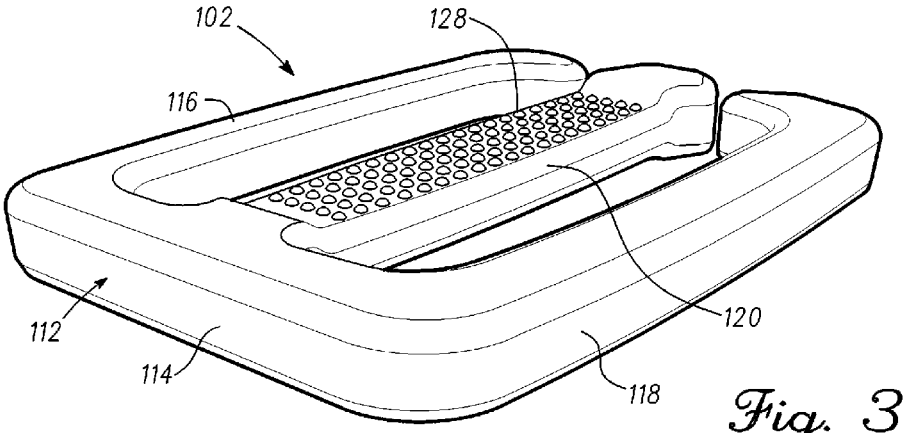
FIG. 3 is another elevated perspective view of the loop clip.

Referring to FIGS. 4 and 5, as noted above the middle portion 120 extends outwardly in a substantially perpendicular fashion from the rear portion 114 and is positioned between the first side portion 116 and the second side portion 118. As shown in FIG. 2, a proximal neck portion 130 transitions the middle portion 120 to the rear portion 114, while a distal neck portion 134 transitions the middle portion 120 to the middle arm 126 defined at the free end of the middle portion 120. In some embodiments, the proximal and distal neck portions 130 and 132 may have a tapered configuration to provide the necessary flexibility to flex the middle portion 120 relative to the first and second side portions 116 and 118. The flexing of the middle portion 120 allows the middle portion 120 of the loop clip 102 to be inserted through the closed loop end 108 of the strap 106 and between the first and second inward arms 122 and 124 of the first and second side portions 116 and 118, respectively, when engaging the strap 106 to the loop clip 102.

Referring to FIG. 4, the middle portion 120 defines a middle arm 126 at the free end thereof that forms first and second outward protrusions 150 and 152. The first and second outward protrusions 150 and 152 of the middle arm 126 in combination with the outward protrusions 154 and 156 of respective first and second inward arms 122 and 124 collectively form the first and second openings 138 and 140, respectively, for allowing the closed loop end 108 to enter first and second slots 134 and 136. In one embodiment, the middle portion 120 may be flexed by an individual in an upward motion 600 or downward motion 602 substantially along axis 400 (FIG. 6) to permit insertion of the middle portion 120 into the closed loop end 108 of the strap 106.

In some embodiments, the front and rear surfaces 139 and 141 between the proximal neck 130 and distal neck 132 of the middle portion 120 may each define a plurality of protrusions 128 configured to provide a gripping surface to maintain the closed loop end 108 in contact with the middle portion 120. In addition, the plurality of protrusions 128 may provide a gripping surface for an individual to grip and flex the middle portion 120 when engaging the closed loop end 108 of the strap 106 to loop clip 102 as shall be discussed in greater detail below.

Figure 10:
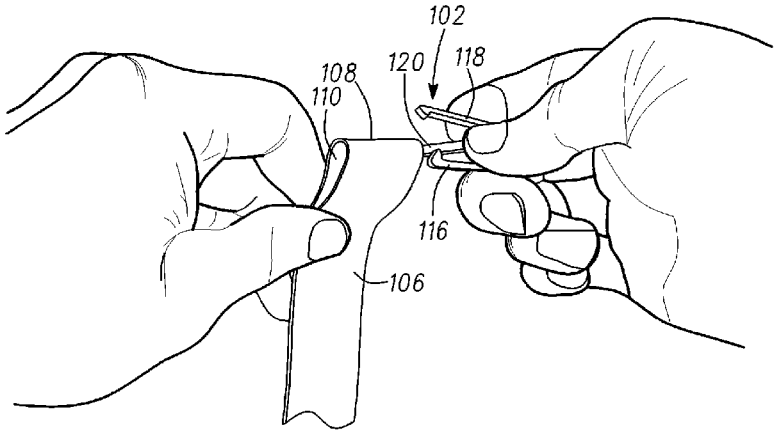
FIGS. 10-12 illustrate a sequence of steps for engaging the loop clip to the strap of the golf bag.
Figure 11:
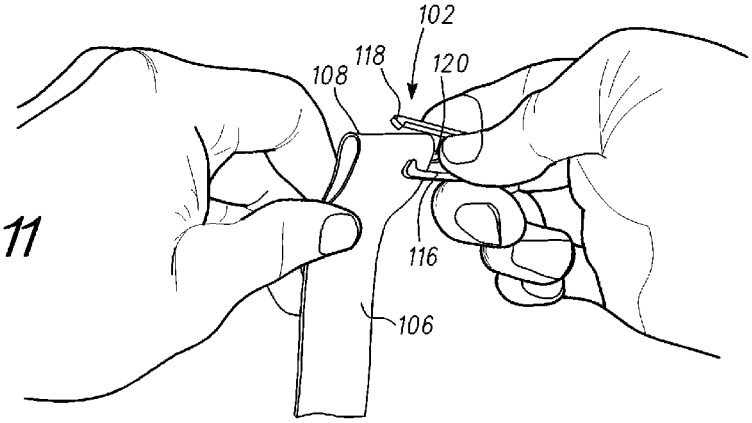

Referring to FIGS. 1 and 10-12, one method for connecting the strap 106 to the golf bag 100 using the loop clip 102 is illustrated. As shown in FIG. 1, the closed loop end 108 of each strap 106 is inserted through a respective slot opening 109 formed through the golf bag body 103 such that the closed loop end 108 extends into the interior area 107 of the golf bag 100. Referring to FIG. 10, an individual grasping the loop clip 102 flexes the middle portion 120 in either the upward motion 600 or downward motion 602 relative to the first and second side portions 116 and 118 to begin inserting the middle portion 120 into the channel 110 formed by the closed loop end 108 of the strap 106. Referring to FIG. 11, the individual continues to insert the middle portion 120 through the channel 110 until the middle arm 126 of the middle portion 120 extends completely through the channel 110 of the closed loop end 108. As shown in FIG. 12, once the middle portion 120 extends completely through the closed loop end 108 of the strap 106, the configuration of the first inward arm 122, second inward arm 124 and middle arm 126 secures and retains the strap 106 to the loop clip 102. The above procedure is repeated for securing another strap 106 to another loop clip 102. After each closed loop end 108 is engaged to a respective loop clip 102 in this manner, each strap 106 is drawn back through the respective slot opening 109 until each loop clip 102 contacts the inner surface 111 of the golf bag body 103 adjacent the slot opening 109 as shown in FIG. 1.

Figure 13:
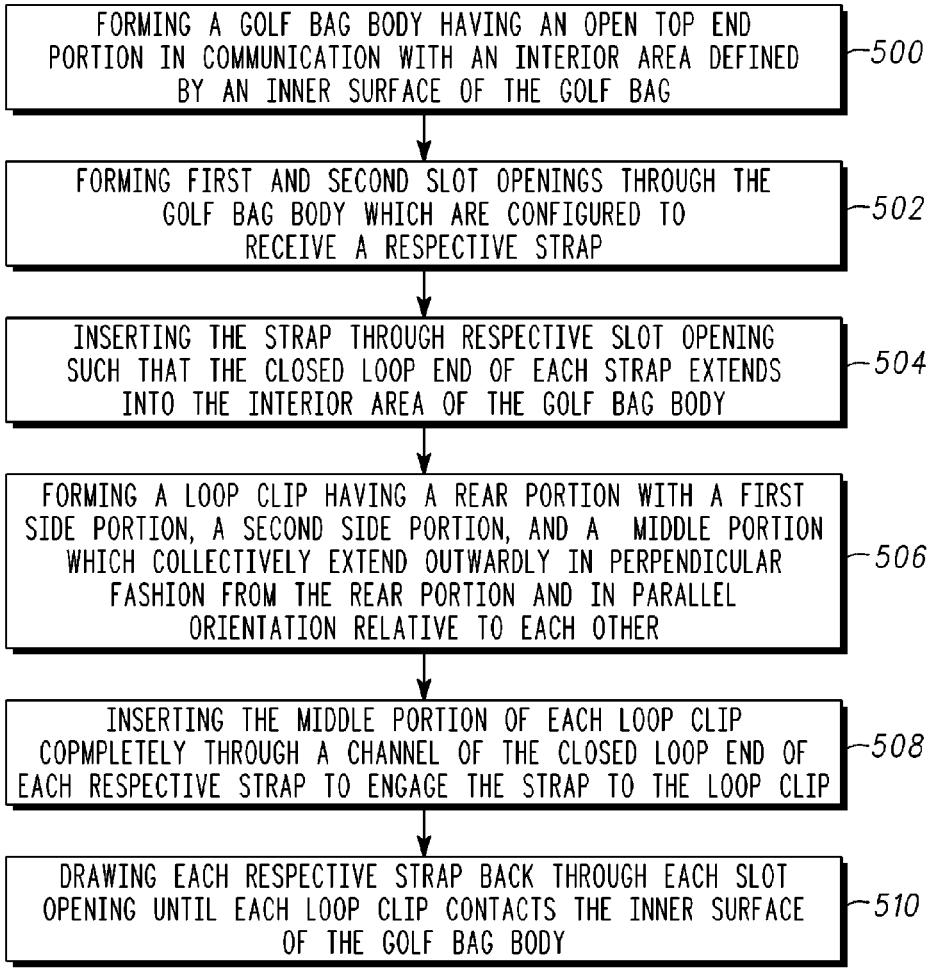
FIG. 13 is a flow chart illustrating one method for manufacturing the golf bag.

Referring to FIG. 13, one method for manufacturing a golf bag 100 is illustrated. At block 500, forming a golf bag body 103 having an open top end portion 105 in communication with an interior area 107 defined by an inner surface 111 of the golf bag body 103. At block 502, forming first and second slot openings 109 through the golf bag body 103 which are configured to receive a respective strap 106. At block 504, inserting a respective strap 106 through either the first or second slot openings 109 such that the closed loop end 108 formed at the free end of each strap 106 extends into the interior area 107 of the golf bag body 103. At block 506, forming a first and second loop clips 102 with each of the first and second loop clips 102 having a rear portion 114 with a first side portion 116, a second side portion 118, and a middle portion 120 which collectively extend outwardly in perpendicular fashion from the rear portion 114 and in parallel orientation relative to each other. At block 508, inserting the middle portion 120 of each loop clip 102 completely through the channel 110 of the closed loop end 108 of a respective strap 106. At block 510, drawing each strap 106 back through the respective first and second slot openings 109 until each of the loop clips 102 contacts the inner surface 111 of the golf bag body 103 adjacent the respective first and second slot openings 109. In this arrangement, the straps 106 connected to the carrying strap assembly 104 are secured to the golf bag body 103 by each respective loop clip 102 such that the weight of the golf bag body 103 may be carried by the carrying strap assembly 104 when an individual carries the golf bag 100.

While a particular order of actions is illustrated in FIG. 13, these actions may be performed in other temporal sequences. For example, two or more actions depicted in FIG. 13 may be performed sequentially, concurrently, or simultaneously. Alternatively, two or more actions depicted may be performed in reversed order. Further, one or more actions depicted in FIG. 13 may not be performed at all. The apparatus, methods, and articles of manufacture described herein are not limited in this regard.

Some embodiments of the loop clip 102 may be manufactured using the following dimensions. Referring back to FIG. 6, the clip body 112 may have a length 300 of about 26 millimeters(mm) (1.02 inches (in)) and a height 302 of about 4 mm (0.15 in.). As shown in FIG. 5, the rear portion 114 may have a length 304 of about 26 mm (1.02 in.), while the first and second side portions 116 and 118 may have the same length 306 of about 35 mm (1.37 in.) and a width 322 of about 4.25 mm (0.16 in.). The middle portion 120 may have an overall length 308 of about 31 mm (1.22 in.) and a width 320 of about 6.25 mm (0.24 in.), while the middle arm 126 of middle portion 120 may have a width 312 of about 7 mm (0.27 in.) and a length 326 of about 5 mm (0.19 in.). In addition, the first and second slots 134 and 136 may each have a width 310 of about 5.5 mm (0.21 in.) and a length 324 of about 25.5 mm (1.00 in.). The first and second inward arms 122 and 124 may each have a length 316 of about 4 mm (0.15 in.) and a width 314 of about 8.5 mm (0.33 in.). Finally, the first and second openings 138 and 140 may each define a distance 318 of about 0.5 mm (0.01 in.).

In some embodiments, the loop clip 102 may be manufactured using a polypropylene material, a polyurethane material, or a combination thereof.

It should be understood from the foregoing that, while particular embodiments have been illustrated and described, various modifications can be made thereto without departing from the spirit and scope of the invention as will be apparent to those skilled in the art. Such changes and modifications are within the scope and teachings of this invention as defined in the claims appended hereto.

What is claimed is:

1. A golf bag comprising:

a golf bag body having a closed bottom end and an open top end in communication with an interior area defined by an inner surface of the golf bag body, wherein the golf bag body is engaged to a first strap configured to define a closed loop end; and a loop clip engaged to the closed loop end of the first strap, the loop clip comprising:

a rear portion;

a first side portion and a second side portion extending outwardly in a substantially perpendicular fashion from the rear portion, wherein the first side portion is in a substantially parallel orientation relative to the second side portion; and a middle portion interposed between the first side portion and the second side portion, the middle portion extending in a substantially perpendicular fashion from the rear portion and in parallel orientation relative to the first side portion and second side portion, wherein the first side portion and the middle portion collectively define a first slot; and the second side portion and the middle portion collectively define a second slot, wherein the middle portion is configured to flex in a substantially upward or downward direction relative to the first and second side portions when a force is applied to the middle portion of the loop clip by an individual.

2. The golf bag of claim 1, wherein the closed loop end defines a channel configured to engage the middle portion of the loop clip when engaging the loop clip to the first strap.

3. The golf bag of claim 1, wherein the first slot of the loop clip is configured to receive one portion of the closed loop end and the second slot of the loop clip is configured to receive another portion of the closed loop end.

4. The golf bag of claim 1, further comprising:

a first slot opening defined through the golf bag body and configured to receive the first strap such that the closed loop end of the first strap extends into the interior area of the golf bag body.

5. The golf bag of claim 1, wherein the closed loop end defines a channel configured to engage the middle portion of the loop clip when engaging the loop clip to the first strap, wherein the middle portion defines a front surface and a rear surface, wherein at least one of the front surface and the rear surface defines a plurality of protrusions configured to substantially contact the channel of the closed loop end.

6. The golf bag of claim 1, wherein the middle portion defines a middle arm having opposing first and second outward protrusions configured to retain the closed loop end of the first strap to the loop clip.

7. The golf bag of claim 1, wherein the first side portion of the loop clip defines a first inward arm and the second side portion of the loop clip defines a second inward arm configured to retain the closed loop end of the first strap to the loop clip.

8. The golf bag of claim 1, further comprising:

a first slot opening defined through the golf bag body and configured to receive the first strap such that the closed loop end of the first strap extends into the interior area of the golf bag body;

a second strap defining a second closed loop end configured to engage a second loop clip, wherein the second loop clip comprises:

a rear portion;

a first side portion and a second side portion extending outwardly in a substantially perpendicular fashion from the rear portion, wherein the first side portion is in a substantially parallel orientation relative to the second side portion; and a middle portion interposed between the first side portion and the second side portion, the middle portion extending in a substantially perpendicular fashion from the rear portion and in a substantially parallel orientation relative to the first side portion and second side portion, wherein the first side portion and the middle portion collectively define a first slot; and the second side portion and the middle portion collectively define a second slot, wherein the middle portion is configured to flex in a substantially upward or downward direction relative to the first and second side portions when a force is applied to the middle portion of the loop clip by an individual; and a second slot opening defined through the golf bag body and configured to receive the second strap such that the second closed loop end of the second strap extends into the interior area of the golf bag body.

9. The golf bag of claim 1, wherein the loop clip is made from a polypropylene material, a polyurethane material, or a combination thereof.

10. A method for manufacturing a golf bag comprising:

forming a golf bag body having an open top end portion in communication with an interior area defined by an inner surface of the golf bag body;

forming a first slot opening through the golf bag body;

inserting a first strap through the first slot opening such that a closed loop end defined at a free end of the first strap extends into the interior area of the golf bag body, wherein the closed loop end of the first strap defines a channel;

forming a first loop clip comprising:

a rear portion;

a first side portion and a second side portion extending outwardly in a substantially perpendicular fashion from the rear portion, wherein the first side portion is in a substantially parallel orientation relative to the second side portion; and a middle portion interposed between the first side portion and the second side portion, the middle portion extending in a substantially perpendicular fashion from the rear portion and in a substantially parallel orientation relative to the first side portion and second side portion, wherein the first side portion and the middle portion collectively define a first slot; and the second side portion and the middle portion collectively define a second slot; and inserting the middle portion of the first loop clip completely through the channel of the closed loop end of the first strap such that the first loop clip is engaged to the closed loop end of the first strap, flexing the middle portion prior to inserting the middle portion into the channel of the closed loop end of the first strap.

11. The method of claim 10, further comprising:

drawing the first strap back through the first slot opening until the first loop clip contacts the inner surface of the golf bag body adjacent the first slot opening.

12. The method of claim 10, further comprising:

forming a second slot opening through the golf bag body;

inserting a second strap through the second slot opening such that the closed loop end of the second strap extends into the interior area of the golf bag body, wherein the closed loop end of the second strap defines a second channel;

forming a second loop clip comprising:

a rear portion;

a first side portion and a second side portion extending outwardly in a substantially perpendicular fashion from the rear portion, wherein the first side portion is in a substantially parallel orientation relative to the second side portion; and a middle portion interposed between the first side portion and the second side portion, the middle portion extending in a substantially perpendicular fashion from the rear portion and in a substantially parallel orientation relative to the first side portion and second side portion, wherein the first side portion and the middle portion collectively define a first slot; and the second side portion and the middle portion collectively define a second slot, wherein the middle portion is configured to flex in a substantially upward or downward direction relative to the first and second side portions when a force is applied to the middle portion of the second loop clip by an individual;

inserting the middle portion of the second loop clip completely through the second channel of the closed loop end of the second strap such that the second loop clip is engaged to the closed loop end of the second strap; and drawing the second strap back through the second slot opening until the second loop clip contacts the inner surface of the golf bag body adjacent the second slot opening.

13. The method of claim 12, further comprising:

flexing the middle portion of the second loop clip in a substantially upward and downward direction relative to the first and second side portions prior to inserting the middle portion of the second loop clip into the second channel of the closed loop end of the second strap.

14. The method of claim 10, wherein forming the loop clip further comprises:

forming the loop clip from a polypropylene material, a polyurethane material, or a combination thereof.

* * * * *